US010609807B2

(12) United States Patent
Suda et al.

(10) Patent No.: US 10,609,807 B2
(45) Date of Patent: Mar. 31, 2020

(54) ACCELERATION CAVITY, ACCELERATOR, AND RESONANCE FREQUENCY ADJUSTMENT METHOD OF ACCELERATION CAVITY

(71) Applicant: MITSUBISHI HEAVY INDUSTRIES MACHINERY SYSTEMS, LTD., Hyogo (JP)

(72) Inventors: Kenji Suda, Saitama (JP); Kazunari Yamada, Saitama (JP); Naruhiko Sakamoto, Saitama (JP); Kazutaka Ozeki, Saitama (JP); Osamu Kamigaito, Saitama (JP); Takeshi Yanagisawa, Hyogo (JP); Katsuya Sennyu, Hyogo (JP)

(73) Assignee: MITSUBISHI HEAVY INDUSTRIES MACHINERY SYSTEMS, LTD., Hyogo (JP)

( * ) Notice: Subject to any disclaimer, the term of this patent is extended or adjusted under 35 U.S.C. 154(b) by 0 days.

(21) Appl. No.: 16/097,706

(22) PCT Filed: May 1, 2017

(86) PCT No.: PCT/JP2017/017207
§ 371 (c)(1),
(2) Date: Oct. 30, 2018

(87) PCT Pub. No.: WO2017/191837
PCT Pub. Date: Nov. 9, 2017

(65) Prior Publication Data

US 2019/0191539 A1 Jun. 20, 2019

(30) Foreign Application Priority Data

May 6, 2016 (JP) ..... 2016-093220

(51) Int. Cl.
*H05H 7/22* (2006.01)
*H05H 9/00* (2006.01)
*H05H 9/02* (2006.01)

(52) U.S. Cl.
CPC ..... *H05H 7/22* (2013.01); *H05H 9/00* (2013.01); *H05H 9/02* (2013.01)

(58) Field of Classification Search
None
See application file for complete search history.

(56) References Cited

U.S. PATENT DOCUMENTS 6,445,267 B1 * 9/2002 Stephan ..... H01P 7/06 333/231
6,657,515 B2 * 12/2003 Pappo ..... H05H 7/20 250/396 R (Continued)

FOREIGN PATENT DOCUMENTS

JP H03015199 A 1/1991
JP 2008117667 A * 5/2008

(Continued)

OTHER PUBLICATIONS

P.N. Ostroumov et al., 'A New Atlas Efficiency and Intensity Upgrade Project', Proceedings of SRF2009, Berlin, Germany, Nov. 2009, pp. 218-222; 5pp.

(Continued)

*Primary Examiner* — Alexander H Taningco
*Assistant Examiner* — Srinivas Sathiraju
(74) *Attorney, Agent, or Firm* — Kanesaka Berner and Partners LLP

(57) ABSTRACT

An objective of the invention is to provide an acceleration cavity, an accelerator, and a resonance frequency adjustment method of an acceleration cavity that can change the natural resonance frequency of the acceleration cavity without occu- (Continued)

pying space between adjacent accelerator cavities. A QWR includes: a body portion whose axial direction is parallel to the vertical direction, and having a cylindrical side face portion; an upper face portion provided in an upper part of the body portion and is a plate-shaped member; and a deformation adjustment portion applying a pressing force on the upper face portion to deform the upper face portion.

8 Claims, 7 Drawing Sheets

(56) References Cited

U.S. PATENT DOCUMENTS

| | | | | |
|---|---|---|---|---|
| 6,876,278 | B2 * | 4/2005 | Rawnick | H01P 7/065 333/219.1 |
| 9,224,571 | B2 * | 12/2015 | Urakawa | H05H 7/08 |
| 10,292,252 | B2 * | 5/2019 | Okihira | H05H 7/02 |
| 2018/0153028 | A1 * | 5/2018 | Hara | G12B 17/04 |
| 2019/0008028 | A1 * | 1/2019 | Okihira | H05H 7/02 |
| 2019/0090342 | A1 * | 3/2019 | Hara | H05H 7/22 |

FOREIGN PATENT DOCUMENTS

| | | | | | |
|---|---|---|---|---|---|
| JP | 2008117667 | A | | 5/2008 | |
| JP | 2017017207 | A | * | 1/2017 | |
| WO | WO-2016139504 | A1 | * | 9/2016 | H05H 7/20 |

OTHER PUBLICATIONS

P.-E. Bernaudin et al., 'Design of the Low-Beta, Quarter-Wave Resonator and Its Cryomodule for the Spiral 2 Project', presented at 9th European Particle Accelerator Conference (EPAC 2004), Jul. 2004; 4pp.

D. Longuevergne et al., 'A Novel Frequency Tuning System Based on Movable Plunger for Spiral2 High-Beta Superconducting Quarterwave Resonator', Proceedings of LINAC08, Victoria, BC, Canada, Conference held on Sep. 29, 2008—Oct. 3, 2008, pp. 789-791; 3pp.

B.K. Sahu et al., 'Use of Piezoelectric Actuator to Frequency Lock Superconducting Quarter Wave Resonator', Proceedings of LINAC08, Victoria, BC, Canada, Conference held on Sep. 29, 2008-Oct. 3, 2008, pp. 815-817; 3pp.

Amit Roy, 'Development of Quarter Wave Resonators', Proceedings of APAC 2007(Asian Particle Accelerator Conference 2007), Raja Ramanna Centre for Advanced Technology(RRCAT), Indore, India, Conference held on Jan. 29, 2007-Feb. 2, 2007, pp. 554-558; 5 pp.

Takahiro Inagaki, 'High Power RF Source', OHO' 13 High Energy Accelerator Seminar, Textbook, Foundation for High Energy Accelerator Science (non-official translation), Jul. 23, 2013; 59 pp.

International Search Report and Written Opinion for PCT/JP2017/017207 dated Jul. 25, 2017; 14 pp.

E. Zaplatin, Low-Beta Superconducting RF Cavity Tune Options', Proceedings of PAC2011 (Particle Accelerator Conference), New York, NY, USA, pp. 865-867; Oct. 19, 2011; 3pp.

T. Junquera et al., "High Intensity Linac Driver for the Spiral-2 Project: Design of Superconducting 88 MHz Quarter Wave Resonators (Beta 0.12), Power Couplers and Cryomodules" Proceedings of EPAC2004, Lucerne, Switzerland, pp. 1285-1287; Sep. 1, 2004; 3pp.

D. Longuevergne et al., "An Innovative Tuning System for Superconducting Accelerating Cavities", Nuclear Instruments and Methods in Physics Research. Section A, vol. 749, pp. 7-13; Mar. 4, 2014; 7pp.

Extended European Search Report for International Application No. PCT/JP2017/017207 dated Dec. 13, 2019; 8pp.

* cited by examiner

ACCELERATION CAVITY, ACCELERATOR, AND RESONANCE FREQUENCY ADJUSTMENT METHOD OF ACCELERATION CAVITY

RELATED APPLICATIONS

The present application is a National Phase of International Application Number PCT/JP2017/017207 filed May 1, 2017 and claims priority from Japanese Application Number 2016-093220 filed May 6, 2016.

TECHNICAL FIELD

The present invention relates to an acceleration cavity, an accelerator, and a resonance frequency adjustment method of an acceleration cavity.

BACKGROUND ART

In a superconducting linear accelerator that accelerates protons or heavy ions, sometimes a quarter wave resonator (QWR) or a half wave resonator (HWR) is used to form an acceleration cavity. Microwaves are input into the acceleration cavity to generate an accelerating field that accelerates the protons or heavy ions. At this time, the particles can be accelerated efficiently by synchronizing the natural resonance frequency of the acceleration cavity with the frequency of the accelerating field. Accordingly, the acceleration cavity needs to be tuned to adjust the resonance frequency of the acceleration cavity.

Patent Literatures 1 and 2 below disclose inventions related to tuning of an acceleration cavity.

CITATION LIST

Patent Literature

[PTL 1] U.S. Pat. No. 6,445,267
[PTL 2] U.S. Pat. No. 6,657,515

SUMMARY OF INVENTION

Technical Problem

Tuning of an acceleration cavity includes those performed before operation and during operation of an accelerator. Examples of tuning (hereinafter referred to as "pre-tuning") before operation include adjustment of the length of some of parts assembled to the inside of the cavity, changing of the cavity shape by plastically deforming the cavity, and polishing of an inner surface of the cavity. Pre-tuning before operation adjusts a wide range of the resonance frequency.

Examples of tuning during operation include reversible adjustment of the cavity shape by elastically deforming the cavity, and insertion of parts into the cavity. Tuning during operation is aimed to recover the resonance frequency when it is slightly changed by operating conditions or the like, for example.

In tuning by deformation of the acceleration cavity, the acceleration cavity is deformed in such a manner as to be recessed inward in a beam axis direction. In a case where multiple accelerator cavities are arranged in series, the gap between cavities may be shortened to increase the proportion of the acceleration cavity to the overall length of the accelerator, whereby the accelerator can be downsized as a whole. Meanwhile, since a QWR or an HWR has a highly rigid structure, a tuner having a function of deforming the resonator needs to be a large structure capable of applying a high deformation force. The tuner has a structure that sandwiches a vertically long cylindrical resonator from its outer peripheral face, for example. At this time, a pressing force that the tuner applies is several tens of kilonewtons. For this reason, a certain space needs to be ensured when a tuner is placed between accelerator cavities.

The present invention has been made in view of the foregoing, and aims to provide an acceleration cavity, an accelerator, and a resonance frequency adjustment method of an acceleration cavity that can change the natural resonance frequency of the acceleration cavity without occupying space between adjacent accelerator cavities, in tuning during operation of the accelerator or pre-tuning before operation of the accelerator.

Solution to Problem

An acceleration cavity according to a first aspect of the present invention includes: a body portion whose axial direction is parallel to the vertical direction, and having a cylindrical side face portion; an upper face portion provided in an upper part of the body portion and is a plate-shaped member; and a deformation adjustment portion applying a pressing force on the upper face portion to deform the upper face portion.

According to this configuration, the body portion having a cylindrical side face portion has its axial direction arranged parallel to the vertical direction, and the upper face portion which is a plate-shaped member is provided in an upper part of the body portion. Here, the deformation adjustment portion applies a pressing force on the upper face portion to deform the upper face portion. Since the upper face portion provided in an upper part of the body portion is deformed, the resonance frequency of the acceleration cavity is changed.

In the above first aspect, multiple deformation adjustment portions may be provided, and each of the deformation adjustment portions may apply a pressing force on a different position in the upper face portion.

According to this configuration, a pressing force can be applied on multiple positions in the upper face portion by multiple deformation adjustment portions. As a result, the change in shape of the upper face portion can be varied more than when a pressing force is applied on one position. Hence, the resonance frequency of the acceleration cavity can be varied more in detail. For example, when the upper face portion is formed into an annular shape, multiple deformation adjustment portions are spaced apart along the circumferential direction of the upper face portion.

In the above first aspect, an upwardly protruding rib may be provided on a plane of the upper face portion, and the deformation adjustment portion may apply a pressing force by coming into contact with the rib.

According to this configuration, the deformation adjustment portion is in contact with the rib provided in the upper face portion, and applies a pressing force on the rib to deform the upper face portion. At this time, since the pressing force is transmitted widely within the plane of the upper face portion through the rib, the deformed part can be increased along the longitudinal direction of the rib.

In the above first aspect, a part of the upper face portion with which the deformation adjustment portion comes into contact may be thinner than other parts.

According to this configuration, since the part with which the deformation adjustment portion comes into contact and applies a pressing force is thinner than other parts, the upper face portion can be deformed with less pressing force.

In the above first aspect, a part of the upper face portion with which the deformation adjustment portion comes into contact may be formed into a flat plate shape.

According to this configuration, since the part with which the deformation adjustment portion comes into contact and applies a pressing force is formed into a flat plate shape whose section is formed of straight lines, the upper face portion can be deformed with less pressing force than when the section is formed of a curved face such as a fan shape.

An accelerator according to a second aspect of the present invention includes the acceleration cavity of the above first aspect.

A resonance frequency adjustment method of an acceleration cavity according to a third aspect of the present invention is a resonance frequency adjustment method of an acceleration cavity including a body portion whose axial direction is parallel to the vertical direction and having a cylindrical side face portion, and an upper face portion provided in an upper part of the body portion and is a plate-shaped member, the method including a step of deforming the upper face portion by applying a pressing force on the upper face portion by a deformation adjustment portion.

In the step of deforming the upper face portion in the above third aspect, the upper face portion is plastically deformed or elastically deformed.

In the above third aspect, in a case where multiple deformation adjustment portions are provided, the upper face portion is deformed by all or some of the deformation adjustment portions.

Advantageous Effects of Invention

According to the present invention, since the upper face portion provided in an upper part of the body portion of the acceleration cavity is deformed, the natural resonance frequency of the acceleration cavity can be changed without occupying space between adjacent accelerator cavities by the deformation adjustment portion.

DESCRIPTION OF EMBODIMENTS

Figure 1:
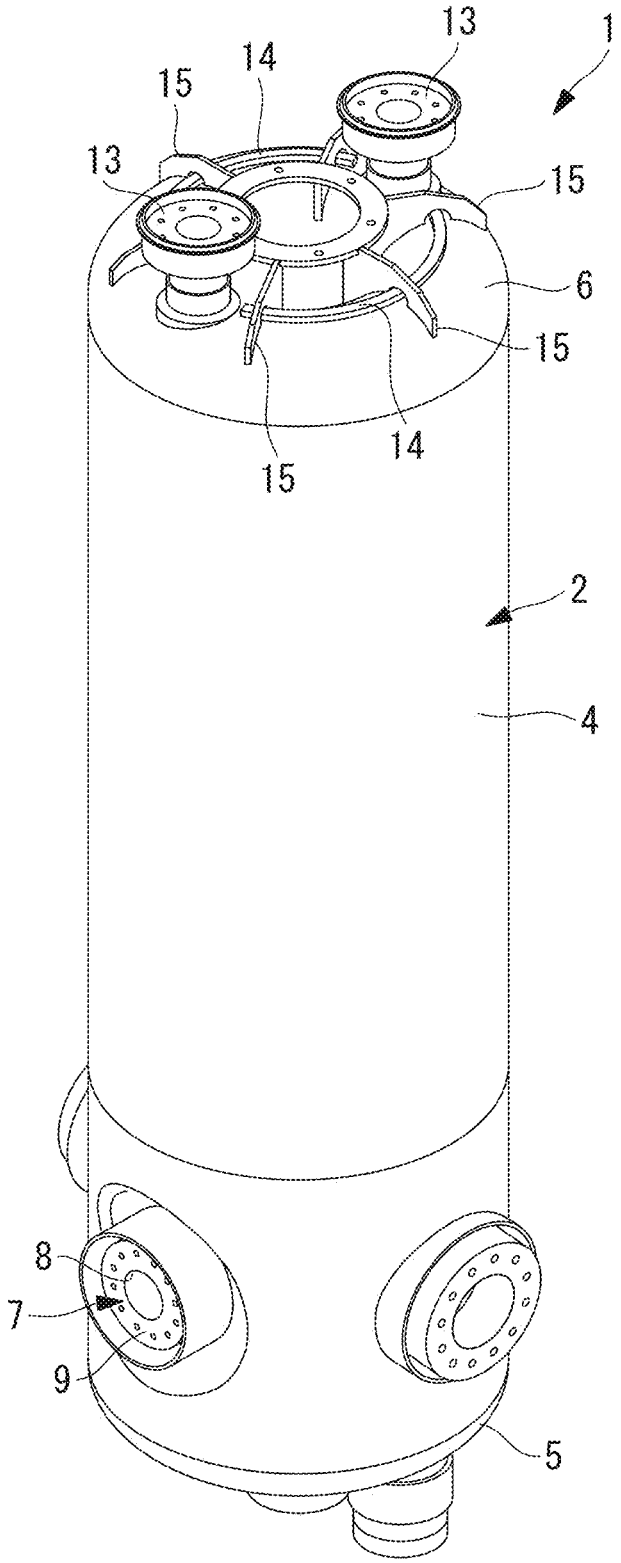
FIG. 1 is a perspective view of a QWR of a first embodiment of the present invention.
Figure 2:
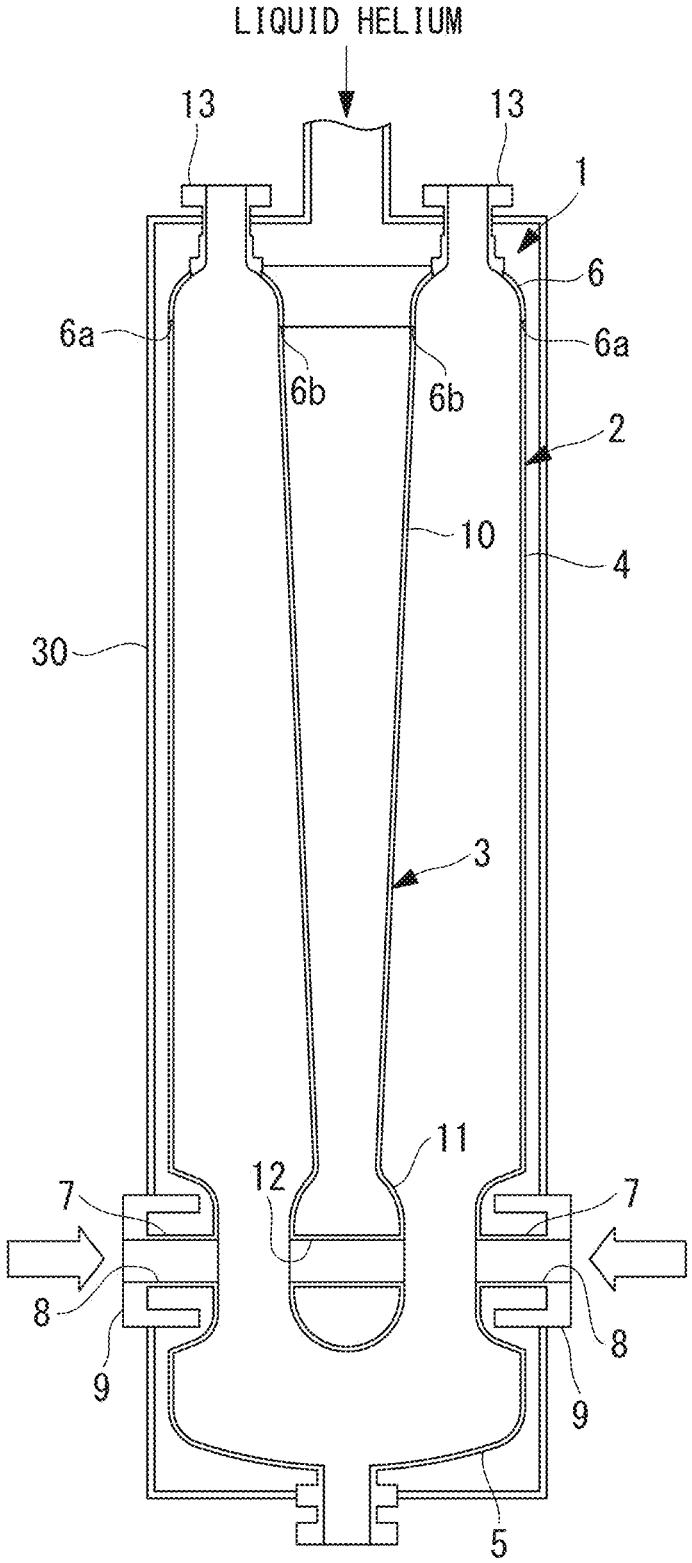
FIG. 2 is a longitudinal section of the QWR and a container of the first embodiment of the present invention.
Figure 3:
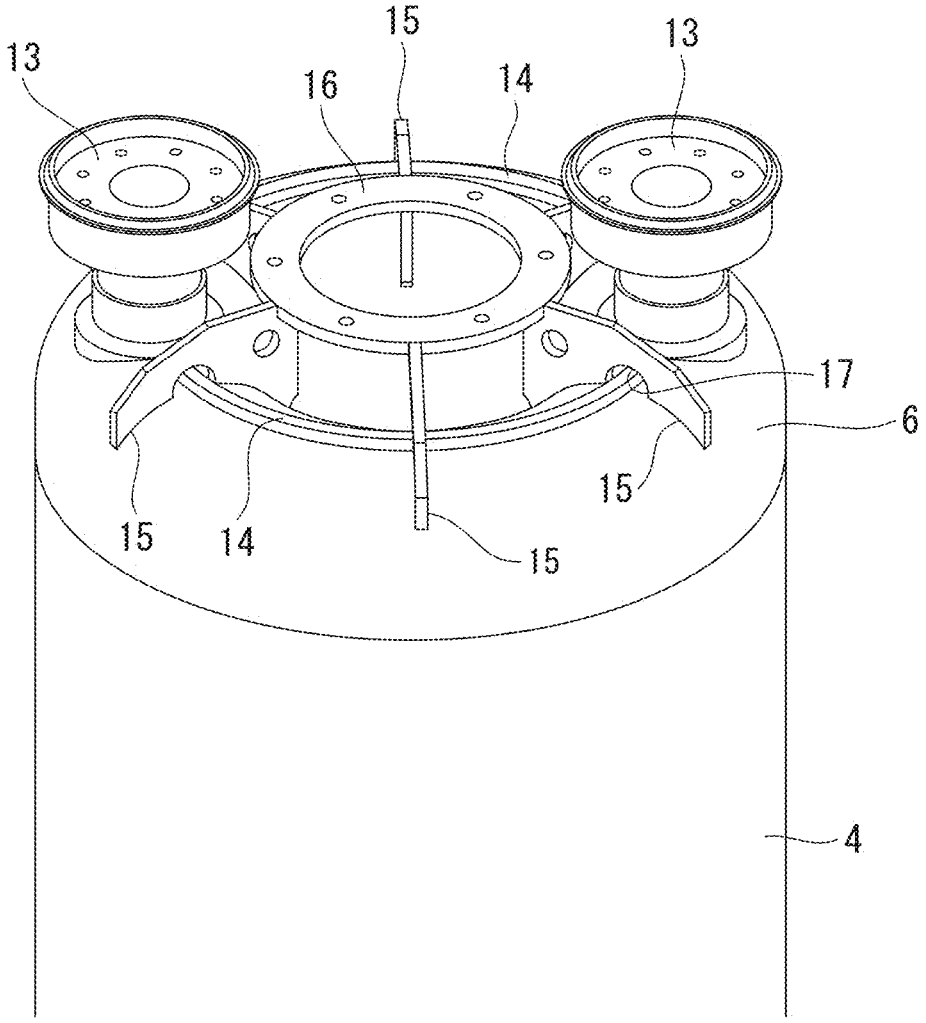
FIG. 3 is a perspective view of an upper part of the QWR of the first embodiment of the present invention.

Hereinafter, embodiment of the present invention will be described with reference to the drawings.

[First Embodiment]

Hereinafter, a superconducting linear accelerator of a first embodiment of the present invention will be described with reference to FIGS. 1 to 8.

The superconducting linear accelerator of the embodiment accelerates protons or heavy ions (heavy ions). The superconducting linear accelerator uses a quarter wave resonator (QWR) 1 to form an acceleration cavity. The QWR 1 is used on its own in some cases, and multiple QWRs 1 are connected in series in other cases. Microwaves are input into the QWR 1, so that an accelerating field that accelerates the protons or heavy ions is generated inside the QWR 1. Note that while the following description is given on the QWR 1 with reference to the drawings, the present invention is also applicable to a half wave resonator (HWR) used in a superconducting linear accelerator.

The QWR 1 is made of niobium, and includes a body portion 2 having a cylindrical side face, a central conductor 3 provided inside the body portion 2, and other parts.

The body portion 2 has a side face portion 4 having a cylindrical outer peripheral face, and a lower face portion 5 and upper face portion 6 connected to the side face portion 4. The side face portion 4, lower face portion 5, and upper face portion 6 are configured of a plate-shaped member having a thickness of 3 mm to 4 mm, for example. The inside of the body portion 2 is a space enclosed by the side face portion 4, lower face portion 5, and upper face portion 6 of the body portion 2, and the central conductor 3.

The lower face portion 5 is circular in plan view, and is formed into a cup shape or a flat plate shape, for example. The upper face portion 6 is annular in plan view, and its longitudinal section includes an upwardly protruding curved face. Note that the upper face portion 6 may have a flat face portion in addition to the curved face.

An outer peripheral edge 6*a* of the upper face portion 6 is connected to an upper part of the side face portion 4, while an inner peripheral edge 6*b* of the upper face portion 6 is connected to an upper part of the central conductor 3.

A pair of beam ports 7 having an opening 8 through which the protons or heavy ions pass are provided in a lower part of the body portion 2. Each beam port 7 has a flange 9 formed in an end part thereof, and is connectable to a beam port 7 of another QWR through a connection part (not shown).

The beam port 7 protrudes from the side face portion 4 of the body portion 2, and is perpendicular to the axial direction of the body portion 2. The two beam ports 7 are provided on the same axis, and the opening 8 formed therein is also arranged on the same axis.

The central conductor 3 has a tapered connection portion 10, and an annular beam passage portion 11 having an opening 12 formed therein. The connection portion 10 has a tapered shape having a large diameter in an upper part thereof, and a small diameter in a lower part thereof. The lower part of the connection portion 10 and an upper part of the beam passage portion 11 are connected to be continuous with each other, so that a continuous space is formed inside the connection portion 10 and the beam passage portion 11. This space is filled with liquid helium, for example, during operation of the accelerator. Note that the connection portion 10 may be formed into a cylindrical shape having the same diameter in upper and lower parts thereof.

The beam passage portion 11 is formed such that two cup-shaped members are combined, and has a curved face protruding toward the beam port 7. A cylindrical opening 12 is formed in a center part of the beam passage portion 11, and both ends of the opening 12 are connected to the face of the beam passage portion 11 on the beam port 7 side. The opening 12 of the beam passage portion 11 is provided on the same axis as the opening 8 of the beam port 7. The protons or heavy ions pass through the inside of the opening 12 of the beam passage portion 11.

The thickness of the beam passage portion 11 in the beam axis direction and the length of the opening 12 in the beam axis direction are longer than the diameter at the lowermost end of the connection portion 10, and the connection part between the connection portion 10 and the beam passage portion 11 has a bent shape. Note that the shape of the connection part between the connection portion 10 and the beam passage portion 11 is not limited to the bent shape. The thickness of the beam passage portion 11 in the beam axis direction and the length of the opening 12 in the beam axis direction may be the same as the diameter of a cylindrical connection portion 10. Moreover, the beam passage portion 11 is not limited to the annular shape, and may be formed into a cylindrical shape having the same diameter as the cylindrical connection portion 10. Here, the opening 12 may be formed to penetrate the outer peripheral face of the cylindrical beam passage portion 11.

A space is formed between the side face portion 4 of the body portion 2 and a side face of the central conductor 3, and between the lower face portion 5 of the body portion 2 and the lowermost end of the central conductor 3. In cross section, the QWR 1 is formed such that the space between the side face portion 4 of the body portion 2 and the side face of the central conductor 3 has an annular shape.

A metal container (jacket) 30 is provided outside the QWR 1, and the space between the inside of the container 30 and an outer peripheral part of the body portion 2 is filled with liquid helium, for example.

A pair of ports 13 are provided parallel to the axial direction of the body portion 2, in the upper face portion 6 of the body portion 2. The ports 13 are used for cleaning and polishing of the internal space during production of the QWR 1.

Additionally, in the upper face portion 6 of the body portion 2, an arc-shaped rib 14 is formed along the circumferential direction between two ports 13. The rib 14 protrudes upward from the plane of the upper face portion 6. By providing the rib 14, a pressing force of a bolt 22 of a deformation adjustment portion 20 is widely transmitted within the plane of the upper face portion 6 through the rib 14. Hence, the deformed part can be increased along the longitudinal direction of the rib 14.

In addition, a plate-shaped supporting portion 15 is provided along the radial direction of the upper face portion 6, between two ports 13. A lower end part of the supporting portion 15 is connected to the upper face portion 6. In the example shown in FIG. 3, six supporting portions 15 are provided along the circumferential direction. Note that the position and number of the supporting portions 15 are not limited to this example. Also note that a cutout 17 is formed in a lower part of the supporting portion 15 to avoid interference with the rib 14.

Moreover, an annular reinforcement member 16 is disposed on the inner side of the multiple supporting portions 15. The outer peripheral edge of the reinforcement member 16 is connected to the supporting portions 15.

Next, the deformation adjustment portion 20 of the embodiment will be described with reference to FIGS. 3 to 8.

The deformation adjustment portion 20 comes into contact with the upper face portion 6 to apply a pressing force thereon, and deforms the plate-shaped member of the upper face portion 6. This changes the natural resonance frequency of the QWR 1.

Figure 4:
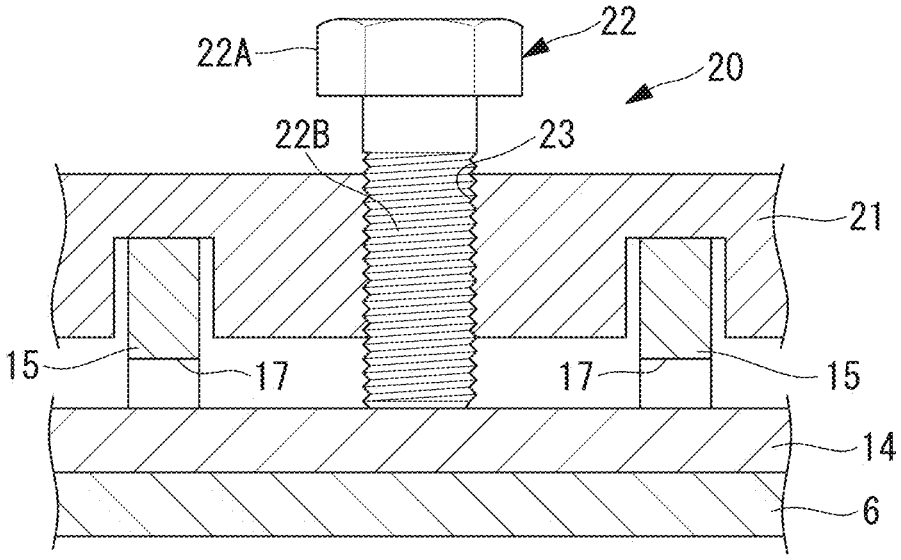
FIG. 4 is a longitudinal section of a deformation adjustment portion of the QWR of the first embodiment of the present invention.
Figure 5:
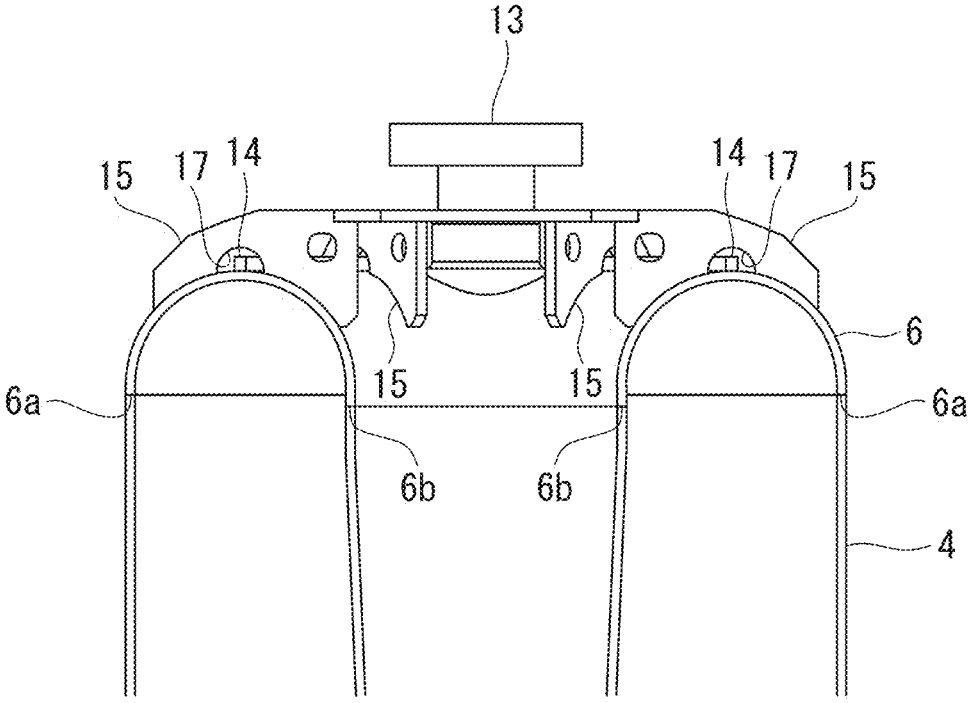
FIG. 5 is a longitudinal section of the upper part of the QWR of the first embodiment of the present invention.
Figure 6:
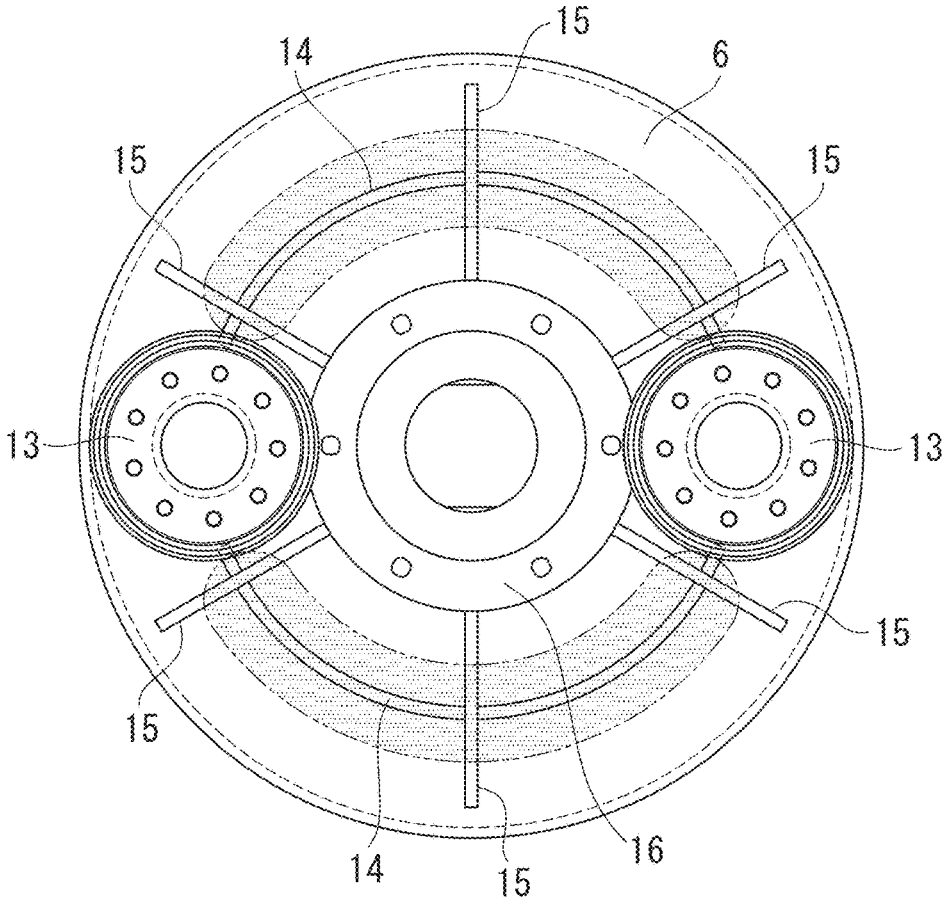
FIG. 6 is a plan view of the QWR of the first embodiment of the present invention.

As shown in FIG. 4, the deformation adjustment portion 20 is provided between two supporting portions 15. FIG. 4 is a longitudinal section cut in the circumferential direction of the upper face portion 6, along the rib 14 of the upper face portion 6. One or more deformation adjustment portions 20 are disposed on the upper face portion 6. In a case where multiple deformation adjustment portions 20 are provided, one deformation adjustment portion 20 is provided between every two supporting portions 15. Not less than one pair of the deformation adjustment portions 20 are disposed preferably in point-symmetric positions. Since the deformation adjustment portions 20 are provided in symmetric positions, the change in resonance frequency is made uniform, and can be easily adjusted. Note that the change in resonance frequency can be made uniform to facilitate adjustment, also by appropriately selecting the thickness and shape of the plate-shaped member of the upper face portion 6 and the plate-shaped member of the rib 14.

The deformation adjustment portion 20 has a base portion 21 and the bolt 22. The base portion 21 is a plate-shaped or block-shaped member, and a lower face thereof is connected to an upper face of the supporting portion 15. A through hole 23 is formed in the vertical direction in a center part of the base portion 21, and a female screw thread that can be screwed with the bolt 22 is provided inside the through hole 23. A head portion 22A is provided in an upper part of the bolt 22, and a male screw is provided in a rod portion 22B. Rotation of the head portion 22A moves the bolt 22 in the axial direction, and the bolt 22 is movable upward or downward with respect to the base portion 21.

Figure 7:
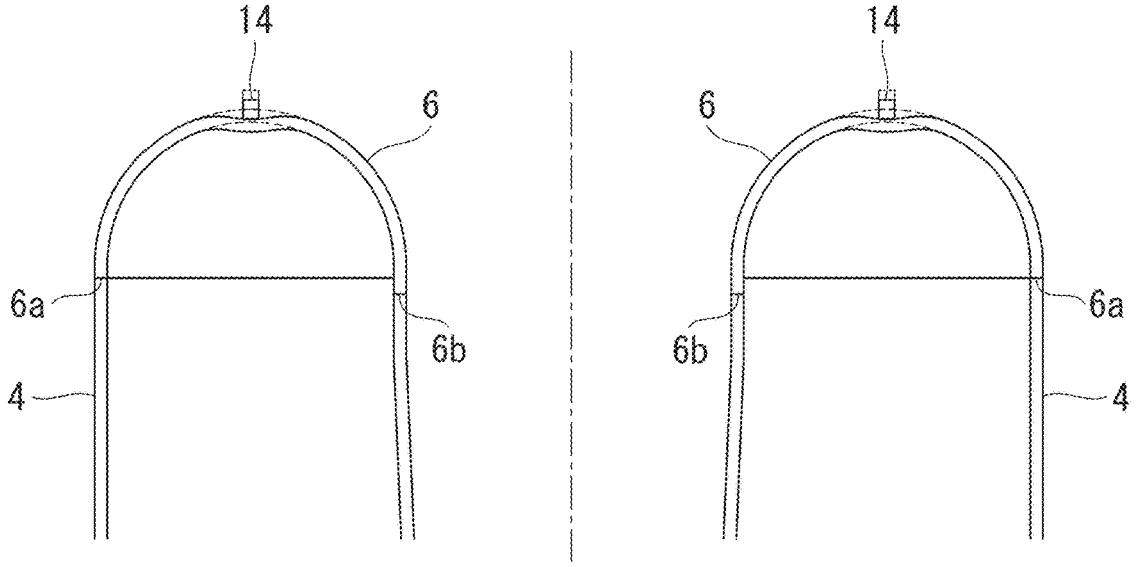
FIG. 7 is an end view of the upper part of the QWR of the first embodiment of the present invention, where the deformed shape of the upper face part is indicated by a broken line.

A downward movement of the bolt 22 brings a lower end part of the rod portion 22B of the bolt 22 into contact with the rib 14 of the upper face portion 6. Further downward movement of the bolt 22 causes the bolt 22 fixed to the base portion 21 and the supporting portion 15 to apply a pressing force on the rib 14 and the upper face portion 6. As a result, as shown in FIG. 7, the rib 14 and the upper face portion 6 are deformed by the bolt 22. The amount of deformation of the rib 14 and the upper face portion 6 can be varied according to the amount of movement of the bolt 22.

Figure 8:
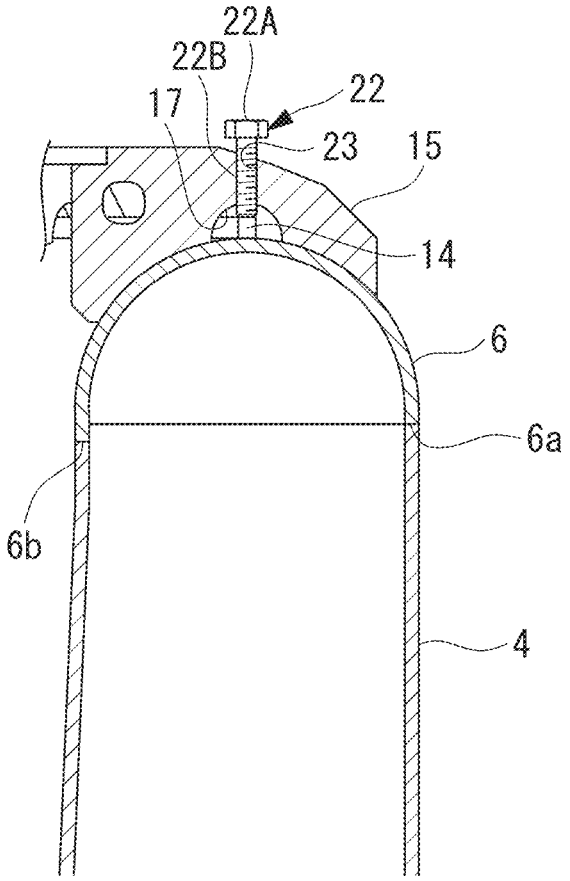
FIG. 8 is a longitudinal section of an upper part of a modification of the QWR of the first embodiment of the present invention.

Note that the deformation adjustment portion 20 is not limited to the configuration including the base portion 21, and as shown in FIG. 8, the bolt 22 may be disposed on the supporting portion 15 without providing the base portion 21. In this case, the supporting portion 15 has a larger thickness, and has a through hole 23 formed in the vertical direction from an end face of the plate-shaped supporting portion 15. A female screw thread that can be screwed with the bolt 22 is provided inside the through hole 23. A lower end part of the rod portion 22B of the bolt 22 protrudes into the cutout 17, and comes into contact with the rib 14 of the upper face portion 6. In this case, too, a downward movement of the bolt 22 can cause the bolt 22 fixed to the supporting portion 15 to apply a pressing force on the rib 14 and the upper face portion 6, to deform the rib 14 and the upper face portion 6. The rib 14 and the upper face portion 6 can be deformed in a predetermined manner, by appropriately selecting the thickness and shape of the plate-shaped member of the upper face portion 6 and the plate-shaped member of the rib 14.

The deformation adjustment portion 20 may plastically deform the rib 14 and the upper face portion 6 by forcible deformation, or may elastically deform the rib 14 and the upper face portion 6 within an elastically deformable range.

For example, in a case of adjusting (pre-tuning) the natural resonance frequency of the QWR 1 before operation, both plastic deformation and elastic deformation are conceivable.

In the case of plastic deformation, the rib 14 and the upper face portion 6 are largely deformed in the plastic deformation. After the plastic deformation, the deformation of the rib 14 and the upper face portion 6 is maintained, even after the bolt 22 of the deformation adjustment portion 20 is moved back up and the lower end part of the rod portion 22B of the bolt 22 is separated from the rib 14. Accordingly, the resonance frequency of the QWR 1 is set to a different value from before the deformation.

In the case of elastic deformation, after the bolt 22 of the deformation adjustment portion 20 is moved downward to adjust the resonance frequency, the bolt 22 is fixed in this position to maintain the deformation of the QWR 1.

Meanwhile, in a case of adjusting (tuning) the natural resonance frequency of the QWR 1 during operation, the rib 14 and the upper face portion 6 are elastically deformed within the elastically deformable range. The bolt 22 of the deformation adjustment portion 20 is moved up and down within the elastically deformable range of the rib 14 and the upper face portion 6. In this case, the amount of deflection of the rib 14 and the upper face portion 6 varies according to the upward and downward movement of the bolt 22.

In a case where multiple deformation adjustment portions 20 are provided, the bolts 22 of all of the deformation adjustment portions 20 may be moved uniformly. Instead, the bolts 22 of some of the deformation adjustment portions 20 may be moved, or the amount of movement of the bolt 22 may be varied among the deformation adjustment portions 20, while measuring the change characteristics of resonance frequency. When the rib 14 and the upper face portion 6 are deformed by multiple deformation adjustment portions 20, the change in shape of the rib 14 and the upper face portion 6 can be varied more than when a pressing force is applied on one position. Hence, the resonance frequency of the QWR 1 can be varied more in detail. The shaded area in FIG. 6 indicates a deformation range in a case where four deformation adjustment portions 20 are provided for the upper face portion 6, and the upper face portion 6 is deformed by using all of the deformation adjustment portions 20. Note that the deformable range of one deformation adjustment portion 20 is the range between two supporting portions 15.

Note that when no tuning is performed during operation, the base portion 21 and the bolt 22 of the deformation adjustment portion 20 may be removed from the supporting portion 15 after completion of the tuning before operation.

As has been described, according to the embodiment, the natural resonance frequency of the QWR 1 can be changed by deforming the upper face portion 6 of the QWR 1. Since the deformation adjustment portion 20 is disposed in an upper part of the QWR 1 in the upper face portion 6 of the QWR 1, the deformation adjustment portion 20 does not interfere with an adjacent QWR 1. Hence, even when there is only a short distance between multiple QWRs 1 and the space between adjacent QWRs 1 is narrow, the resonance frequency can be changed by use of the deformation adjustment portion 20.

Additionally, unlike the conventional configuration in which a beam port of a QWR is moved inward and a side face portion 4 is recessed inward in the beam axis direction, in the embodiment, the position of the beam port 7 is not changed. Hence, the natural resonance frequency of the QWR 1 can be changed without largely affecting the accelerating field generated inside the QWR 1.

Note that while the embodiment describes a case where the rib 14 is provided on a plane of the upper face portion 6 in the QWR 1, the present invention is not limited to this example. That is, the rib 14 may be omitted, and the bolt 22 may come into contact with the upper face portion 6 to directly deform the upper face portion 6.

Moreover, the thickness of the upper face portion 6 with which the bolt 22 comes into contact may be formed thinner than other parts of the upper face portion 6 or the side face portion 4. Accordingly, since the part where the bolt 22 of the deformation adjustment portion 20 comes into contact and deforms the upper face portion 6 is thinner than other parts, the upper face portion 6 can be deformed with less pressing force.

[Second Embodiment]

Next, a superconducting linear accelerator of a second embodiment of the present invention will be described.

The embodiment is mainly used when the natural resonance frequency of a QWR 1 is adjusted (tuned) during operation.

The QWR 1 of the superconducting linear accelerator of the embodiment differs from the first embodiment in the configuration of a deformation adjustment portion 20. Hereinafter, the deformation adjustment portion 20 of the QWR 1 will be described, and detailed descriptions of components and effects that overlap with the first embodiment will be omitted. Note that while the following description is given on the QWR 1 with reference to the drawings, the present invention is also applicable to a half wave resonator (HWR) used in a superconducting linear accelerator.

Figure 9:
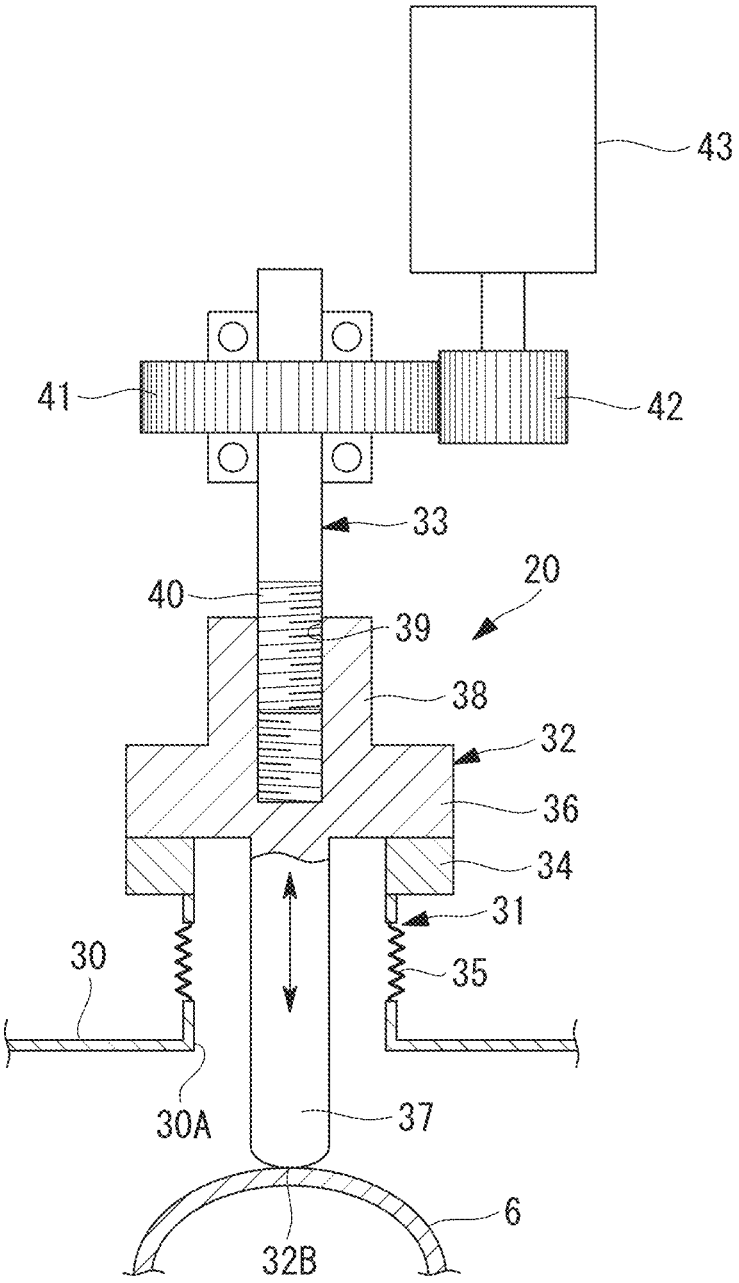
FIG. 9 is a longitudinal section of a deformation adjustment portion of a QWR of a second embodiment of the present invention.

As shown in FIG. 9, the deformation adjustment portion 20 is placed outside a container 30. The container 30 is filled with liquid helium, for example.

The deformation adjustment portion 20 has a supporting portion 31, a rod portion 32, a rod position adjustment portion 33, and other parts. The deformation adjustment portion 20 deforms a rib 14 and an upper face portion 6, by causing the rod position adjustment portion 33 to change the vertical position of the rod portion 32, and bring a lower end portion 32B of the rod portion 32 into contact with the upper face portion 6.

A circular opening 30A, for example, is formed in an upper face of the container 30, and the rod portion 32 is inserted into the opening 30A. The supporting portion 31 is a cylindrical member, for example, and a lower end part thereof is set on an upper face side of the container 30 along the opening 30A. A flange 34 is provided in an upper end part of the supporting portion 31, and the flange 34 is in contact with a lower face of a bracket portion 36 of the rod portion 32. A bellows 35 is provided in a middle part of the supporting portion 31, and the bellows 35 enables vertical movement of the flange 34.

The rod portion 32 has the bracket portion 36 supported by the supporting portion 31, a bar-like rod 37 extending downward, and a female screw portion 38 in which a female screw hole 39 is formed.

The bracket portion 36 is a circular plate-shaped member, for example, has a larger diameter than the rod 37, and has a lower face side in contact with an upper face of the flange 34 of the supporting portion 31. Additionally, the rod 37 is connected to the center of the bracket portion 36. The lower end of the rod 37 brings the lower end portion 32B of the rod portion 32 into contact with the upper face portion 6. The female screw hole 39 is formed at the center of the female screw portion 38 in the same direction as the axial direction of the rod portion 32, and a female screw thread is formed therein. The female screw portion 38 is screwed with a male screw portion 40 of the rod position adjustment portion 33.

The rod position adjustment portion 33 has the male screw portion 40, a first gear 41, a second gear 42, a motor 43, and other parts, for example. The motor 43 is capable of normal and reverse rotation.

The first gear 41 is connected to the male screw portion 40, and the second gear 42 is connected to the motor 43. The first gear 41 meshes with the second gear 42. Driving of the motor 43 rotates the second gear 42, and the rotational force of the second gear 42 is transmitted to the first gear 41. Then, rotation of the first gear 41 rotates the male screw portion 40. As a result, the rod portion 32 screwed with the male screw portion 40 does not rotate about the shaft center but moves in the axial direction, and is movable upward or downward with respect to the container 30. Specifically, the rod portion 32 is kept from rotating about the shaft center, and is capable of moving in the axial direction, that is, in the vertical direction.

The downward movement of the rod portion 32 brings the lower end portion 32B of the rod portion 32 into contact with the upper face portion 6, and further downward movement of the rod portion 32 deforms the upper face portion 6. The amount of deformation of the upper face portion 6 can be varied according to the amount of movement of the rod portion 32.

Note that while the embodiment describes a case where the rod portion 32 deforms the upper face portion 6, as in the case of the first embodiment, a rib 14 may be provided on a plane of the upper face portion 6, and the rod portion 32 may deform the upper face portion 6 and the rib 14.

According to the embodiment, the deformation adjustment portion 20 is provided outside the container 30, and the upper face portion 6 of the QWR 1 can be deformed by use of the deformation adjustment portion 20 from outside the container 30.

Moreover, instead of directly operating the bolt 22 as in the case of the first embodiment, the rod portion 32 can be moved vertically by driving the motor 43. Hence, even when the container 30 is filled with liquid helium during operation and the QWR 1 is difficult to access, the upper face portion 6 of the QWR 1 can be deformed by remote control.

REFERENCE SIGNS LIST

1 QWR
2 body portion
3 central conductor
4 side face portion
5 lower face portion
6 upper face portion
7 beam port
8, 12 opening
9 flange
10 connection portion
11 beam passage portion
13 port
14 rib
15 supporting portion
20 deformation adjustment portion
21 base portion
22 bolt
30 container
31 supporting portion
32 rod portion
33 rod position adjustment portion
34 flange
35 bellows
36 bracket portion
37 rod
38 female screw portion
39 female screw hole
40 male screw portion
41 first gear
42 second gear
43 motor

The invention claimed is:

1. An acceleration cavity, comprising:

a body portion whose axial direction is parallel to a vertical direction, and having a cylindrical side face portion;

an upper face portion which is provided in an upper part of the body portion and is a plate-shaped member;

a deformation adjustment portion applying a pressing force on the upper face portion to deform the upper face portion, wherein an upwardly protruding rib that is a plate-shaped member is provided on a plane of the upper face portion, the deformation adjustment portion applies a pressing force by coming into contact with the rib, and the upper face portion is annular, and has a vertically upwardly protruding curved face.

2. The acceleration cavity according to claim 1, wherein a plurality of the deformation adjustment portions are provided, each of the deformation adjustment portions applying a pressing force on a different position in the upper face portion.

3. The acceleration cavity according to claim 1, wherein a part of the upper face portion with which the deformation adjustment portion comes into contact is thinner than other parts.

4. The acceleration cavity according to claim 1, wherein a part of the upper face portion with which the deformation adjustment portion comes into contact is formed into a flat plate shape.

5. An accelerator comprising the acceleration cavity according to claim 1.

6. A method for resonance frequency adjustment of an acceleration cavity, the acceleration cavity including:

a body portion whose axial direction is parallel to a vertical direction and having a cylindrical side face portion, an upper face portion which is provided in an upper part of the body portion and is a plate-shaped member, the upper face portion being annular and having a vertically upwardly protruding curved face, and an upwardly protruding rib as a plate-shaped member being provided on a plane of the upper face portion, the method comprising:

deforming the upper face portion by a deformation adjustment portion applying a pressing force on the upper face portion by coming into contact with the rib.

7. The method according to claim 6, wherein in the deforming of the upper face portion, the upper face portion is plastically deformed or elastically deformed.

8. The method according to claim 6, wherein a plurality of the deformation adjustment portions are provided, and the upper face portion is deformed by all or some of the deformation adjustment portions.

* * * * *